US005927485A

United States Patent [19]

Linek et al.

[11] Patent Number: 5,927,485

[45] Date of Patent: Jul. 27, 1999

[54] AUXILIARY SWITCH INCLUDING CAM OPERATED, U-SHAPED LEAF SPRING BRIDGING CONTACT ARRANGEMENT

[75] Inventors: Reiner Linek; Manfred Schimkat, both of Dresden, Germany

[73] Assignee: Allen-Bradley Company, Milwaukee, Wis.

[21] Appl. No.: 09/058,168

[22] Filed: Apr. 9, 1998

Related U.S. Application Data

[30] Foreign Application Priority Data

Sep. 9, 1997 [CH] Switzerland ..... 2113/97

[51] Int. Cl.[6] ..... H01H 15/00; H01H 1/50

[52] U.S. Cl. ..... 200/551; 200/16 R

[58] Field of Search ..... 200/1 A, 1 B, 200/1 V, 5 R, 6 B, 6 BA, 6 BB, 533–535, 542, 545, 546, 551, 552, 283, 243

[56] References Cited

U.S. PATENT DOCUMENTS

| | | | |
|---|---|---|---|
| 3,249,725 | 5/1966 | Hutt et al. | 200/551 |
| 3,715,545 | 2/1973 | Long | 200/533 |
| 3,770,921 | 11/1973 | Wilbrecht | 200/551 |
| 4,331,844 | 5/1982 | Saitoh | 200/16 R |
| 4,366,351 | 12/1982 | Ditzig | 200/16 R |
| 4,395,609 | 7/1983 | Sowash | 200/16 R X |
| 4,885,435 | 12/1989 | Dix | 200/1 B |
| 4,983,788 | 1/1991 | Pardini | 200/16 R |

FOREIGN PATENT DOCUMENTS 347999 4/1995 European Pat. Off. .

*Primary Examiner*—J. R Scott

*Attorney, Agent, or Firm*—David G. Luettgen; John M. Miller; John J. Horn

[57] ABSTRACT

An auxiliary switch arrangement is located inside a housing (1) and is equipped with at least two fixed contact pieces (2, 3, 4), with one connecting contact bridge (9, 10) which can be uncoupled in pairs from the contact bridge. The contact bridge (9, 10) is formed onto one end of a U-shaped curved leaf spring strip (11), transverse to the longitudinal direction of the leaf spring strip (11). The other, free end (12) of the leaf spring strip (11), is fastened inside the housing (1). The leaf spring strip (11) is pre-tensioned by the amount of contact pressure in the contact-making position of the contact bridge (9, 10). A slide (14) equipped with linear cams (15, 18, 19, 20, 21), which moves in a guide inside of the housing (1), lifts the movable contact pieces (17) off the fixed contact pieces (2, 3, 4) in the switched-off position. The slide (14) is actuated through an extension (16) by a switching device. The design of the leaf spring strip (11) permits an economically advantageous manufacture and automatic assembly of the auxiliary switch.

15 Claims, 2 Drawing Sheets

AUXILIARY SWITCH INCLUDING CAM OPERATED, U-SHAPED LEAF SPRING BRIDGING CONTACT ARRANGEMENT

BACKGROUND OF THE INVENTION

1. Field of the Invention

The present invention relates to an auxiliary switch arrangement having at least two fixed contact pieces that are fastened inside a housing, and at least one spring-loaded contact bridge that connects or leaves disconnected the fixed contact pieces depending on the position of a slide equipped with linear cams.

2. Description of Related Art

European Patent EP-B1-0347999 which corresponds to U.S. Pat. No. 4,983,788, describes an auxiliary switch arrangement of the type mentioned above. In this auxiliary switch arrangement, two or more fixed contact pieces are arranged inside a housing. In a switched-on position, the two fixed contact pieces are connected to each other by a movable contact bridge. The contact bridge is attached as a bar on one end of a T-shaped hinge pivot swing lever, which is attached inside the housing with its other end. The swing lever is spring-loaded in the closing direction of the contact pieces by a helical spring. Inside the housing, a slide with linear cams is bearing-supported so that it can move. Generally, the slide is coupled onto an electrical switching device and is moved along with movable contact pieces of the switching device. The linear cams on the slide engage the swing levers and move them with the contact bridges against the spring action. In a switched-off position of the auxiliary switch, the cams lift the contact bridges off the fixed contact pieces. In the switched-on position, the helical spring generates the contact pressure for the contact bridge.

A primary disadvantage of this auxiliary switch arrangement is that the swing lever must be pivoted inside the housing in a hinged manner, which requires the provision of bearing supports. The assembly of the swing levers in conjunction with the helical coil makes the auxiliary switch arrangement unsuitable for automatic assembly.

U.S. Pat. No. 3,016,440 describes another similarly designed auxiliary switch arrangement which has an additional helical spring. However, the additional helical spring adds to the number of components, the assembly cost, and the actuating force which must be generated by the actuators of the electrical switching device. In addition, the additional helical spring can result in matching problems when coupling onto different switching devices with dissimilar strokes.

U.S. Pat. No. 3,675,168 describes a switching device with a fixed contact piece located inside a housing and with a movable contact piece attached to one end of a U-shaped, curved leaf spring strip. The other free end of the leaf spring strip is fastened onto the housing, and serves as an electrical connection point. The movable contact piece on one end of the leaf spring strip is engaged and disengaged with the fixed contact piece by a slide through a cam arrangement which is away from the contact point.

A primary disadvantage of this auxiliary switch arrangement is that the electro-dynamic forces that occur within the parallel parts of the U-shaped leaf spring strip, especially during an excess current, can excite oscillations and result in contact separation. In addition, the current-carrying U-shaped leaf spring strip is heated by the flowing current which, especially during excess currents, can alter the spring characteristics of the leaf spring strip.

SUMMARY OF THE INVENTION

A primary object of the present invention is to provide an auxiliary switch arrangement that has relatively few components, that is suitable for automatic assembly with the associated economic advantages, and that retains its functional efficiency during all potential current loadings.

This object is achieved in that the contact bridge is formed on one end of a U-shaped curved leaf spring strip transverse to the longitudinal orientation of the leaf spring strip, and in that the other, free end of the U-shaped curved leaf spring strip is fastened inside the housing, such that the leaf spring strip is pre-tensioned by the amount of contact pressure in the contact-making position of the contact bridge.

Advantageously, in this arrangement, the movable contact bridge and the leaf spring strip generating the contact pressure for the movable contact pieces may consist of one piece, which can be fastened onto the housing. Additionally, this arrangement is suited for automatic assembly and is economically advantageous. By not making the leaf spring strip a current conductor, the current that flows through the auxiliary switch does not impact the auxiliary switch arrangement characteristics.

The leaf spring strip between both of the movable contact pieces located between both end sections of the contact bridge advantageously projects beyond the contact bridge, such that the protruding part forms a sliding bar that interacts with the slide cams. The sliding bar, which is formed from the material of the leaf spring strip, completes the function of the single-piece leaf spring strip.

Preferably, several contact bridges and a common slide with several cams that are assigned to each contact bridge are provided. Using several contact bridges and a slide having the appropriately arranged cams, any number of opening and/or closing contacts can be provided, as required.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

Figure 1:
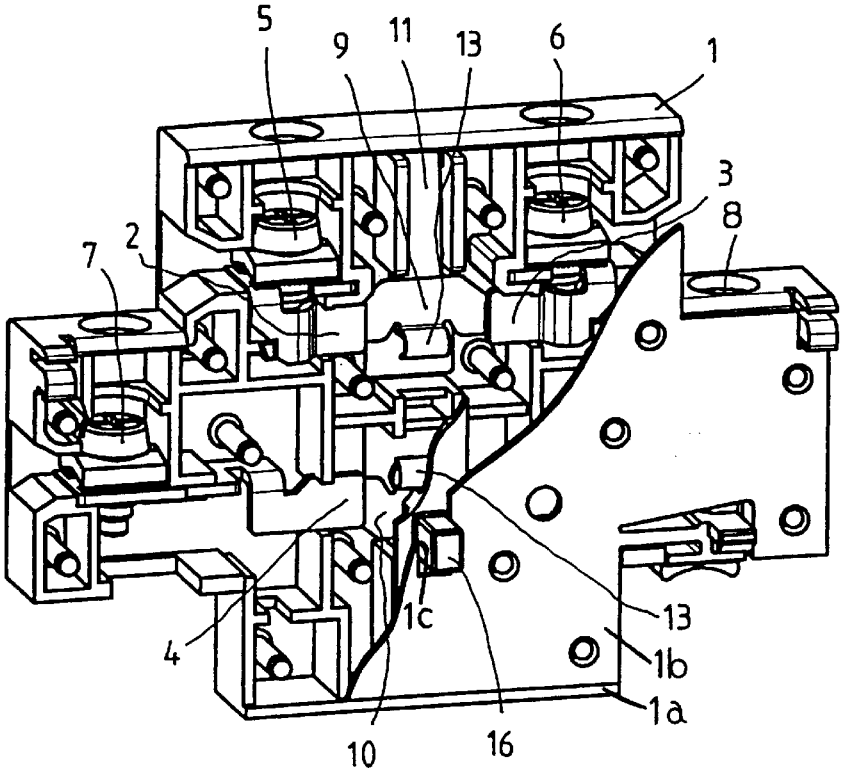
FIG. 1 is a partial cross section perspective view of an auxiliary switch arrangement according to an embodiment of the present invention.

FIG. 1 is a partial cross section perspective view of an auxiliary switch arrangement according to an embodiment of the present invention.

The auxiliary switch arrangement includes a housing 1, which seals off the internal switch arrangement from the outside. The housing 1 consists of a lower housing portion 1*a*, and an upper cover portion 1*b*. The upper cover portion 1*b* includes a slot 1*c*. The auxiliary switch arrangement also includes fixed contact pieces 2, 3, and 4 which are fastened inside the housing 1 and which are electrically connected to terminals 5, 6, and 7, respectively, of the auxiliary switch. Another fixed contact piece, which is not illustrated, is electrically connected to terminal 8 of the auxiliary switch. The fixed contact piece 2 is electrically connected to the fixed contact piece 3 in the switched-on position of contact bridge 9, and the fixed contact piece 4 is electrically connected to the non-illustrated fixed contact piece in the switched-on position of contact bridge 10.

Figure 5:
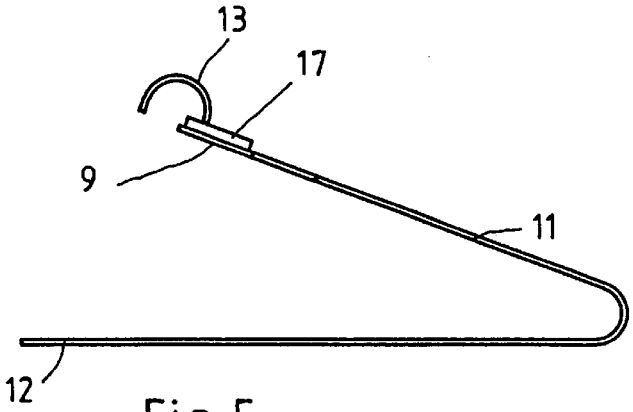
FIG. 5 is a side elevation view of the leaf spring strip of FIG. 4.
Figure 4:
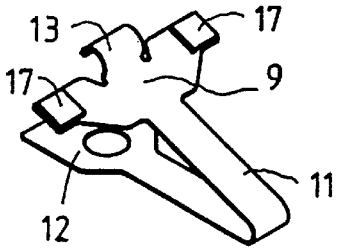
FIG. 4 is a perspective view of a leaf spring strip used in the auxiliary switch of FIG. 1.
Figure 6:
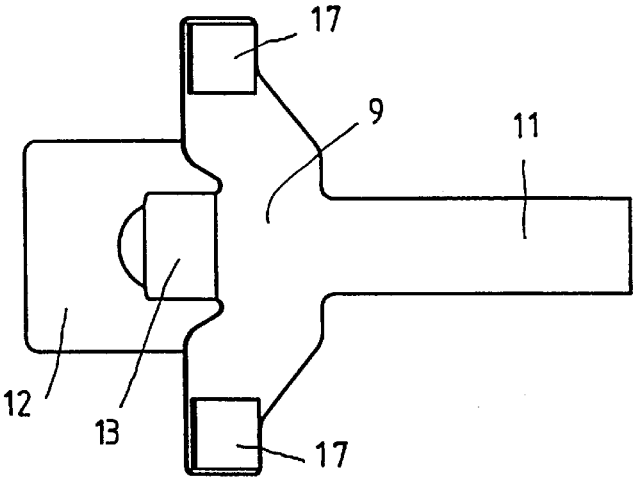
FIG. 6 is a front elevation view of the leaf spring strip of FIG. 4.

The contact bridges 9 and 10 are formed on one end of each of two U-shaped curved leaf spring strips 11 (see FIGS. 4–6). The other ends 12 of the leaf spring strips 11 are fastened inside the housing 1. The leaf spring strips 11 generate the contact pressure in the contact-making switched-on position of the contact bridges 9 and 10, because they are pre-tensioned by the amount of the contact pressure.

Protruding parts of the leaf spring strips 11 project between both end sections of the contact bridges 9 and 10 beyond the contact bridges 9 and 10, such that the protruding parts form sliding bars 13. The sliding bars 13 lift the contact bridges 9 and 10 off the fixed contact pieces 2, 3, and 4, and thus put the auxiliary switch into the switched-off position.

Figure 2:
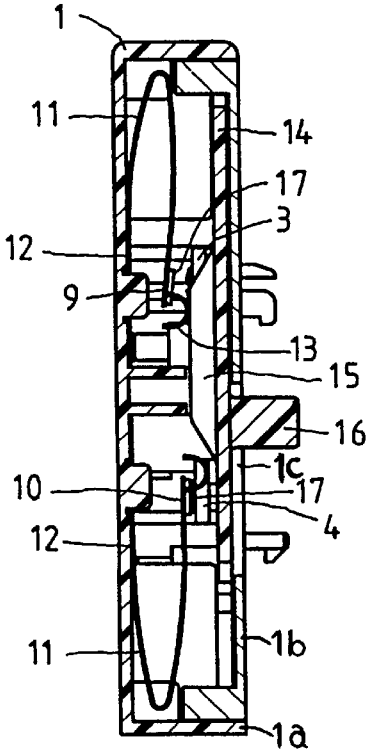
FIG. 2.is a side view of the auxiliary switch of FIG. 1, with a slide in an upper position.

The auxiliary switch arrangement is equipped with a slide 14, which is held and guided longitudinally, and which is movable inside of the housing 1. The slide 14 is provided with a linear cam 15. FIG. 2 illustrates the slide 14 in an upper position. In this position, it is seen that the linear cam 15 is pushed under the sliding bar 13 of the upper contact bridge 9. As a result, the contact bridge 9 is lifted off the fixed contact pieces 2 and 3, thereby interrupting the connection between the terminals 5 and 6. It is also seen that the sliding bar 13 of the contact bridge 10 is free. As a result, the contact bridge 10 connects the fixed contact piece 4 and the non-illustrated fixed contact piece, thereby making the connection between the terminals 7 and 8.

Figure 3:
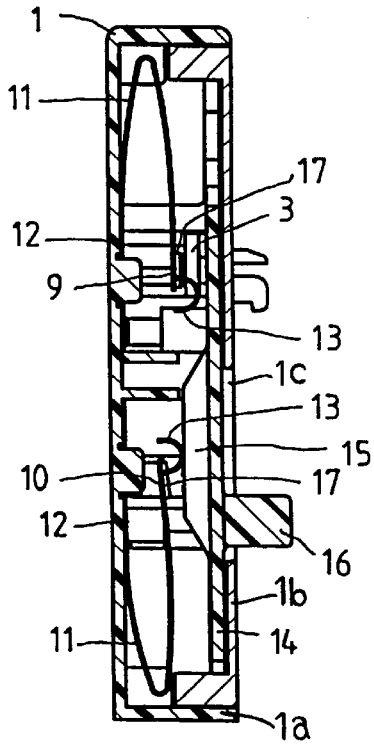
FIG. 3 is a side view of the auxiliary switch of FIG. 1, with the slide in a lower position.

FIG. 3 illustrates the auxiliary switch arrangement with the slide 14 in a lower position. In this position, the fixed contact pieces 2 and 3 are connected, because the sliding bar 13 of the upper leaf spring strip 11 is free, and the contact bridge 9 rests on the fixed contact pieces 2 and 3. The contact pressure results from the pre-tensioning of the leaf spring strip 11. The slide 14 is provided with an extension 16, which can be moved by an electrical switching device (not illustrated).

FIGS. 4–6 illustrate one of the single-piece leaf spring strips 11. Movable contact pieces 17 that are fastened onto the leaf spring strip 11 are depicted most clearly in FIGS. 4 and 6. The contact bridge 9 is transversely oriented with respect to the longitudinal orientation of the leaf spring strip 11, which is the right-to-left direction in FIG. 6.

Figure 7:
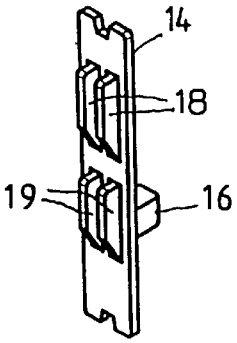
FIGS. 7–9 are perspective views of a slide with differently arranged cams.
Figure 8:
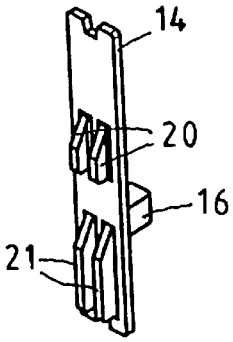
Figure 9:
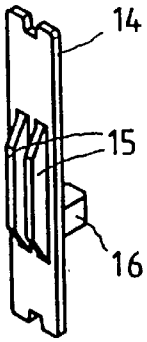

FIGS. 7–9 illustrate the slide 14 with differently arranged cams 15, 18, 19, 20, and 21. By way of the differently arranged cams 15, 18, 19, 20, and 21, the closing and/or opening contacts can be selected as needed. The cams 18 and 19 illustrated in FIG. 7 actuate two opening contacts. The cams 20 and 21 illustrated in FIG. 8 actuate two closing contacts. The cams 15 illustrated in FIG. 9 actuate one opening contact and one closing contact.

Many other changes and modifications may be made to the present invention without departing from the spirit thereof. The scope of these and other changes will become apparent from the appended claims.

We claim:

1. An auxiliary switch arrangement comprising:

(A) a housing;

(B) first and second fixed contact pieces, the first and second fixed contact pieces being fastened inside the housing; and (C) a single-piece leaf spring strip, the leaf spring strip being U-shaped, and the leaf spring strip having (1) a first end, the first end being fastened inside the housing, and (2) a second end, the second end having a spring-loaded contact bridge formed thereon, the contact bridge being transversely oriented with respect to a longitudinal direction of the leaf spring strip, the contact bridge being movable between a switched-off position and a switched-on position by movement of a slide having linear cams actuated through a switching device, the contact bridge electrically connecting the first and second fixed contact pieces in the switched-on position, the contact bridge being lifted off the first and second fixed contact pieces by the cams of the slide in the switched-off position, and the leaf spring strip being pre-tensioned by the amount of contact pressure in the switched-on position of the contact bridge.

2. The auxiliary switch arrangement according to claim 1, wherein a protruding portion of the leaf spring strip projects beyond the contact bridge, the protruding portion being disposed between first and second movable contact pieces of the contact bridge, the first and second movable contact pieces being located between first and second end sections of the contact bridge, the protruding portion forming a sliding bar that cooperates with the cams of the slide to move the contact bridge between the switched-off position and the switched-on position.

3. The auxiliary switch arrangement according to claim 2, wherein the leaf spring strip is a first leaf spring strip and the contact bridge is a first contact bridge, wherein the auxiliary switch arrangement further comprises a second leaf spring strip having a second contact bridge formed thereon, and wherein both the first and second contact bridges are movable between switched-on and switched-off positions by the movement of the slide.

4. The auxiliary switch arrangement according to claim 1, wherein the contact bridge includes first and second movable contact pieces, wherein the first movable contact piece is electrically connected to the second movable contact piece, and wherein, in the switched-on position, the first and second movable contact pieces engage the first and second fixed contact pieces, respectively, thereby causing the contact bridge to electrically connect the first and second fixed contact pieces.

5. An auxiliary switch arrangement comprising:

(A) a housing;

(B) first and second fixed contact pieces, the first and second fixed contact pieces being fastened inside the housing; and (C) a leaf spring strip, the leaf spring strip being U-shaped, and the leaf spring strip having (1) a first end, the first end being fastened inside the housing, and (2) a second end, the second end having a spring-loaded contact bridge formed thereon, the contact bridge including first and second movable contact pieces, the first and second movable contact pieces being movable with respect to the first and second fixed contact pieces, the first and second movable contact pieces being movable between a switched-on position in which the first and second movable contact pieces connect the first and second fixed contact pieces and a switched-off position in which the first and second movable contact pieces leave the first and second fixed contact pieces disconnected.

6. The auxiliary switch arrangement according to claim 5, wherein a protruding portion of the leaf spring strip projects beyond the contact bridge, the protruding portion being disposed between the first and second movable contact pieces, the first and second movable contact pieces being disposed on opposite lateral sides of the leaf spring strip, and the protruding portion forming a sliding bar that cooperates with the cams of the slide to move the first and second movable contact pieces between the switched-off position and the switched-on position.

7. The auxiliary switch arrangement according to claim 6, wherein the leaf spring strip is a first leaf spring strip and the contact bridge is a first contact bridge, wherein the auxiliary switch arrangement further comprises a second leaf spring strip having a second contact bridge formed thereon, and wherein both the first and second contact bridges are movable between switched-on and switched-off positions by movement of a common slide.

8. The auxiliary switch arrangement according to claim 5, wherein the leaf spring strip generates a contact pressure, the contact pressure causing the first and second movable contact pieces to engage the first and second fixed contact pieces in the switched-on position.

9. The auxiliary switch arrangement according to claim 5, further comprising a slide having linear cams, the slide being actuated by a switching device, and wherein the slide moves the first and second movable contact pieces between the switched-on position and the switched-off.

10. The auxiliary switch arrangement according to claim 5, wherein the leaf spring strip is a single piece leaf spring strip.

11. The auxiliary switching arrangement according to claim 5, wherein a portion of the contact bridge extending from the first movable contact piece to the second movable contact piece is transversely oriented with respect to a longitudinal orientation of the leaf spring strip.

12. A method of switching between a switched-on position and a switched-off position of an auxiliary switch, the method comprising:

(A) providing the auxiliary switch with a housing, first and second fixed contact pieces fastened inside the housing, and a U-shaped leaf spring strip, the leaf spring strip having a contact bridge disposed at one end thereof with first and second movable contact pieces;

(B) switching the auxiliary switch to the switched-on position from the switched-off position to establish an electrical connection between the first and second fixed contact pieces, including the steps of (1) moving a slide in a first direction, the moving step being performed by a switching device, and (2) pressing the first and second movable contact pieces against the first and second fixed contact pieces, the pressing step being performed by the leaf spring strip, the pressing step occurring in response to the movement of the slide in the first direction, the first and second movable contact pieces establishing the electrical connection between the first and second fixed contact pieces; and (C) switching the auxiliary switch to the switched-off position from the switched-on position, including the steps of (1) moving the slide in a second direction, the second direction being opposite the first direction, the moving step being performed by the switching device, and (2) lifting the first and second movable contact pieces off the first and second fixed contact pieces, the lifting step being performed by the cams of the slide, the cams applying a force to the contact bridge which acts against a force simultaneously applied to the contact bridge by the leaf spring strip, the lifting step occurring in response to the movement of the slide in the second direction, the lifting of the first and second movable contact pieces off the first and second fixed contact pieces interrupting the electrical connection between the first and second fixed contact pieces.

13. The method according to claim 12 wherein, during the lifting step, the cams of the slide act upon a sliding bar of the leaf spring strip, the sliding bar being formed of a protruding portion of the leaf spring strip which projects beyond the contact bridge and which is disposed between first and second movable contact pieces of the contact bridge.

14. The method according to claim 12 wherein, during the providing step, the leaf spring strip is provided as a single piece.

15. The method according to claim 12, wherein the providing step includes the step of transversely orienting the contact bridge with respect to the longitudinal orientation of the leaf spring strip.

* * * * *